US006658822B1

(12) United States Patent
Dittrich

(10) Patent No.: US 6,658,822 B1
(45) Date of Patent: Dec. 9, 2003

(54) PACKAGING SMOKING ARTICLES

(75) Inventor: David John Dittrich, Southampton (GB)

(73) Assignee: British American Tobacco (Investments) Limited, London (GB)

( * ) Notice: Subject to any disclaimer, the term of this patent is extended or adjusted under 35 U.S.C. 154(b) by 0 days.

(21) Appl. No.: 09/926,030

(22) PCT Filed: Jan. 28, 2000

(86) PCT No.: PCT/GB00/00239

§ 371 (c)(1),
(2), (4) Date: Aug. 17, 2001

(87) PCT Pub. No.: WO00/48907

PCT Pub. Date: Aug. 24, 2000

(30) Foreign Application Priority Data

Feb. 17, 1999 (GB) ..... 9903487

(51) Int. Cl.[7] ..... B65B 61/20

(52) U.S. Cl. ..... 53/474; 53/400; 53/431; 206/213.1; 131/274; 426/124

(58) Field of Search ..... 53/400, 428, 431, 53/444, 474, 111 RC, 370.3, 373.3, 383.1, 148, 238; 206/213.1, 242; 131/274–279, 283; 426/112, 124, 120

(56) References Cited

U.S. PATENT DOCUMENTS

| | | | | | |
|---|---|---|---|---|---|
| 3,846,404 | A | * | 11/1974 | Nichols | 536/76 |
| 4,726,171 | A | * | 2/1988 | Kreager et al. | 53/410 |
| 4,912,910 | A | * | 4/1990 | Lowe et al. | 53/429 |
| 5,092,107 | A | * | 3/1992 | Lamm | 53/449 |
| 5,656,315 | A | * | 8/1997 | Tucker et al. | 426/420 |
| 5,791,124 | A | * | 8/1998 | Spatafora | 53/456 |
| 5,885,640 | A | * | 3/1999 | Andersson | 426/316 |
| 5,901,710 | A | * | 5/1999 | Barber | 131/274 |
| 5,938,018 | A | * | 8/1999 | Keaveney et al. | 206/261 |
| 5,957,278 | A | * | 9/1999 | Krawec et al. | 206/223 |
| 6,209,290 | B1 | * | 4/2001 | Boriani et al. | 53/445 |

* cited by examiner

*Primary Examiner*—Stephen F. Gerrity
*Assistant Examiner*—John Paradiso
(74) *Attorney, Agent, or Firm*—Jones, Tullar & Cooper PC

(57) ABSTRACT

A method of packaging smoking articles, such as cigarettes, includes applying a volatile flavourant to the surface of a pack or an insert for the pack immediately prior to the pack being assembled about a smoking article bundle. The volatile flavourant can migrate within the fully assembled pack from the surface to which it was applied to the smoking articles.

15 Claims, 2 Drawing Sheets

PACKAGING SMOKING ARTICLES

FIELD OF THE INVENTION

The present invention relates to the packaging of smoking articles. More particularly, the present invention relates to a method of packaging smoking articles whereby the resultant packaged smoking articles comprise a volatile flavourant.

DESCRIPTION OF THE PRIOR ART

Smoking articles comprising volatile flavourant (s), for example menthol or peppermint, are well known within the tobacco industry. Thus, for example, the smoking articles may be mentholated cigarettes. Numerous methods are available for the incorporation of volatile flavourant in smoking articles. For example, during the manufacture of smoking articles, e.g. cigarettes, volatile flavourant may be added to the cut tobacco prior to transfer thereof to a continuous smoking material rod making machine, or volatile flavourant may be added to the smoking material rod, e.g. tobacco rod, during the manufacture thereof in the making machine. Alternatively, volatile flavourant can be added to filter rods of such smoking articles during filter manufacture on a filter making machine. However, application of volatile flavourant during the manufacture of smoking articles or parts thereof, is disadvantageous. For example, such application results in contamination of machinery used in the manufacture of smoking articles or parts thereof. The contamination effects moreover downstream machinery including so-called tipping machinery which tipping machinery is operable to interattach smoking material rods and filter rods. Furthermore, packaging machinery used in the packaging of such smoking articles is also likely to be contaminated with the volatile flavourant. Such contamination is extremely undesirable, as prior to such contaminated machinery being used in respect of smoking articles absent the volatile flavourant, the machinery must be decontaminated. Such decontamination is, of course, extremely laborious and time-consuming, and can result in extensive periods in which the machinery is unusable. In addition, if flavourant, for example menthol, is applied to the cigarette paper during manufacture of the smoking article, smoking articles comprising volatile flavourants applied in such a manner have a greater propensity to adhere each with the other during the transfer thereof from making machinery to packaging machinery. Such adherence tends to occur whilst smoking articles are held in reservoirs, which reservoirs are situated between the making machinery and the packaging machinery.

In order to attempt to overcome such long standing problems resulting from application of volatile flavourants during smoking article manufacture, application of the volatile flavourants to the packaging of smoking articles has been contemplated, the intention being that subsequent to the packaging operation volatile flavourant migrates to the smoking articles.

During the packaging of smoking articles, cigarettes for example, a pre-determined number of smoking articles are arranged in a manner, an"assemblage", suitable for being packaged in a smoking article pack. Usually, the smoking article assemblage is then enwrapped in a so-called inner wrap, the inner wrap typically comprising paper having a metallic layer applied thereto, such paper being commonly known as foil or foil tissue in the tobacco industry. Immediately prior to the foil being enwrapped about the smoking articles, the foil is embossed for the purpose of rendering the foil more susceptible to being folded and to enhance the aesthetics of the foil. The assemblage is then transferred onto an unassembled smoking article pack. The foil is anchored to the rear panel of the pack by adhesive. If the pack is of the type commonly known as a hinged-lid pack, the pack at this stage typically takes the form of a flat blank and prior to assembly thereof an inner frame is positioned on the assemblage. Whereas if the pack is of the type commonly known as a soft-cup pack, the pack at this stage typically takes the form of a flat label. The pack is subsequently assembled about the assemblage; that is to say the pack blank/label is folded about the assemblage, such that the pack is maintained in its assembled form by relevant panels of the pack being inter adhered by means of adhesive. Subsequently, the pack may be hermetically sealed; for example a polypropylene outer wrap may be applied about the pack.

Heretofore, volatile flavourants have been applied to the inner wrap, see for example EP 0 531 221. However, application of volatile flavourants to the foil or other inner wrap has many disadvantages. The volatile flavourants are applied to the foil prior to the foil being presented to the smoking article packaging machine, i.e. off-line. Foil with volatile flavourants applied thereto must then be stored in a sealed environment at low temperature until such time as the treated foil is required for use on the smoking article packaging machine. Furthermore, the foil must then be allowed to return to ambient temperature over a period of 2–3 days prior to being suitable for use. As stated above, following upon presentation of the foil to a smoking article packaging machine, the foil is embossed. Embossing flavourant loaded foil results in a condition of the embossing rollers referred to as"blinding". That is to say, the embossing surfaces of the embossing rollers become covered in flavourant residue and thus the quality of the embossing effected by the rollers decreases. In an attempt to overcome such blinding of the embossing rollers, resort has been had to the expedient of blowing hot air onto the embossing rollers in order that the residue thereon evaporates. However, such measures result in substantial losses of volatile flavourant.

SUMMARY OF THE INVENTION

It is an object of the present invention to provide an improved method of packaging smoking articles with the incorporation of volatile flavourant. It is a further object of the present invention to provide improved apparatus for packaging smoking articles with the incorporation of volatile flavourant.

The present invention provides a method of packaging smoking articles, wherein on a smoking article packaging machine, a pack is assembled about an assemblage of smoking articles, characterised in that prior to said pack having been fully assembled about said assemblage, volatile smoking article flavourant is applied at a surface, which surface is a surface within the fully assembled pack, whereby within the fully assembled pack volatilised the flavourant may migrate from the surface to the smoking articles.

The present invention further provides, in combination, a smoking article packaging machine and volatile flavourant application means, the smoking article packaging machine being operable to assemble a pack about an assemblage of smoking articles, and the volatile flavourant application means comprising nozzle means and being operable to supply volatile flavourant to and through the nozzle means at a surface prior to the pack having been fully assembled, which surface is a surface within the fully assembled pack.

Preferably, the surface to which the flavourant is applied is an inner surface of the fully assembled pack. Alternatively, the surface may, instead of being a surface of the pack, be a surface of a pack insert which is disposed within the fully assembled pack. Such pack inserts take the form of coupons, cards or similar sheet like items.

Preferably, the volatile smoking article flavourant is applied directly to the surface.

The assemblage of smoking articles suitably comprises a number of smoking articles arranged in a compact configuration. Preferably, the assemblage or a portion thereof is enwrapped in an inner wrap. The inner wrap layer is preferably, foil or paper.

Advantageously, when the assemblage is enwrapped in an inner wrap, the inner wrap is anchored to the pack by means of an adhesive.

Much by preference, if the surface to which the volatile flavourant is applied is a surface of the pack, the volatile smoking article flavourant is applied to the pack prior to the commencement of the assembly of the pack about the assemblage. In respect to packs of the hinged-lid type, these are normally formed from a single blank. However, as a person skilled in the art will be aware, the pack may be comprised of more than one blank. Suitably, the volatile flavourant may be applied to a pack blank prior to the assemblage of smoking articles being placed onto the blank. Alternatively, the volatile flavourant can be applied when the blank is partially assembled. Typically, and particularly in the case of hinged-lid packs, the assembled packs are rectilinear, having top, bottom, first and second side, front and rear walls. The volatile flavourant may be applied to the inside surface of one or more of these walls. Preferably, the volatile flavourant is applied to the portion of the pack that forms the inner surface of the rear wall of the assembled pack. Furthermore, by way of another alternative, the volatile flavourant may be applied in conjunction with, or may be incorporated into adhesive, which adhesive adheres, for example, the inner wrap to an inner surface of the pack. The assembled pack is secured by the application of seam adhesive along overlapping panels of the pack. By way of a further alternative, the volatile flavourant may be incorporated into the seam adhesive.

Typically, once the pack has been fully assembled, the pack is hermetically or substantially hermetically sealed, for example by way of a polypropylene overwrap being wrapped and sealed about the pack.

The volatile flavourant applied at the surface is in gaseous communication with the smoking articles packaged within the fully assembled pack. Thus during storage of the packaged smoking articles, the volatilised flavourant may migrate from the surface to which the flavourant has been applied to the smoking articles. When equilibrium is reached, the proportion of a volatile flavourant, for example menthol, will typically be about 10–15% by weight on the pack, or on the pack and the insert; and thus the proportion of the volatile flavourant in the smoking articles, e.g. cigarettes will typically be about 85–90% by weight.

The present invention has particular significance in respect to hinged-lid packs, soft-cup packs or shell-and-slide packs. However, the present invention may also be applicable to packs of the type known as either Laube or shoulder packs. In the case that the pack is a hinged-lid pack comprising an inner frame, the inner frame is considered, for the purposes of the present invention, as part of the pack and the volatile flavourant may thus be added to a surface of the inner frame during the assembly of the pack on the packaging machine.

Preferably, the volatile flavourant is menthol and/or peppermint. However, as a person skilled in the art will readily appreciate, the present invention is applicable with respect to any other suitable volatile flavourants.

As will also be appreciated, a flavourant used for the purposes of the present invention may be a multi-component composition, of which one or more components are substantially volatile and one or more of the components are of a lesser volatility or are non-volatile. For example, the multicomponent composition may comprise a flavourant and a carrier substance.

Suitably, the volatile flavourant is applied in a liquid or molten state. The concentration of such molten volatile flavourant, menthol for instance, may be 100%. Alternatively, the volatile flavourant may be applied in solution in a suitable solvent, for example an alcohol such as ethanol.

Suitably, the volatile flavourant application means forms part of the smoking article packaging machine or is located adjacent thereto.

As will be readily apparent to those skilled in the art, the time elapsed between the application of the volatile flavourant on the surface and the completion of the pack assembly step should be short so as to avoid loss, or undue loss, of the flavourant by volatilisation before the assembly step has been completed.

During the application of the flavourant to the surface, the surface and the nozzle means of the application means are in relative movement or are relatively stationary.

The volatile flavourant may be applied at the surface in any suitable pattern. A suitable example is one or more lines.

Advantageously, either one or both of the smoking article packaging machine and the volatile flavourant application means comprises sensing means, which sensing means senses the relative disposition of the surface and of the nozzle means. The sensing means may be optical, mechanical or electrical sensing means. Alternatively, the sensing means may be separate from the packaging machine and the application means. The sensing means is advantageously in communication with the volatile flavourant application means, such that the supply of volatile flavourant to and/or through the nozzle means of the application means can be switched on or off by the sensing means.

Preferably, the application means further comprises supply means and/or reservoir means for the volatile flavourant. Supply means for flavourant suitably interconnects the nozzle means and reservoir means. Supply means and/or the nozzle means advantageously comprise valve means, needle valve means for example. The aforesaid sensing means suitably switches the supply of volatile flavourant to and/or through the nozzle means by controlling valve means in the supply means and/or the nozzle means.

The nozzle means may comprise one or more nozzles.

Preferably, one or more of the nozzle means, the supply means and the reservoir means is/are heatable.

Suitable application means is commercially available from, for example, C. B. Kaymich & Co. Limited of Sheffield, U. K. under model designation FDU3.

The mass loading per pack of the volatile flavourant, when the flavourant is formulated with a vehicle, can be regulated by changing the concentration of the volatile flavourant in relation to the vehicle. Regulation may also be effected whether or not a vehicle substance is present, by adjusting the flow rate per unit time of the flavourant through the nozzle means. If the flow rate is maintained constant, regulation may be effected by changing the duration of flavourant application.

By way of example, the loading of molten menthol, when menthol is the volatile flavourant, applied per smoking article pack for twenty smoking articles is suitably between about 30 to 120 mg. However, as a person skilled in the art will readily appreciate, lower or higher application levels may be applied depending upon the loading requirement of the smoking articles. Of course, a person skilled in the art would be capable of adjusting the applied loading of the volatile flavourant to provide smoking articles with the desired loads therein.

BRIEF DESCRIPTION OF THE DRAWINGS

In order that the present invention may be clearly understood and readily carried into effect, reference will now be made, by way of example, to the accompanying diagrammatic drawings, wherein.

DESCRIPTION OF THE PREFERRED EMBODIMENT

Figure 1:
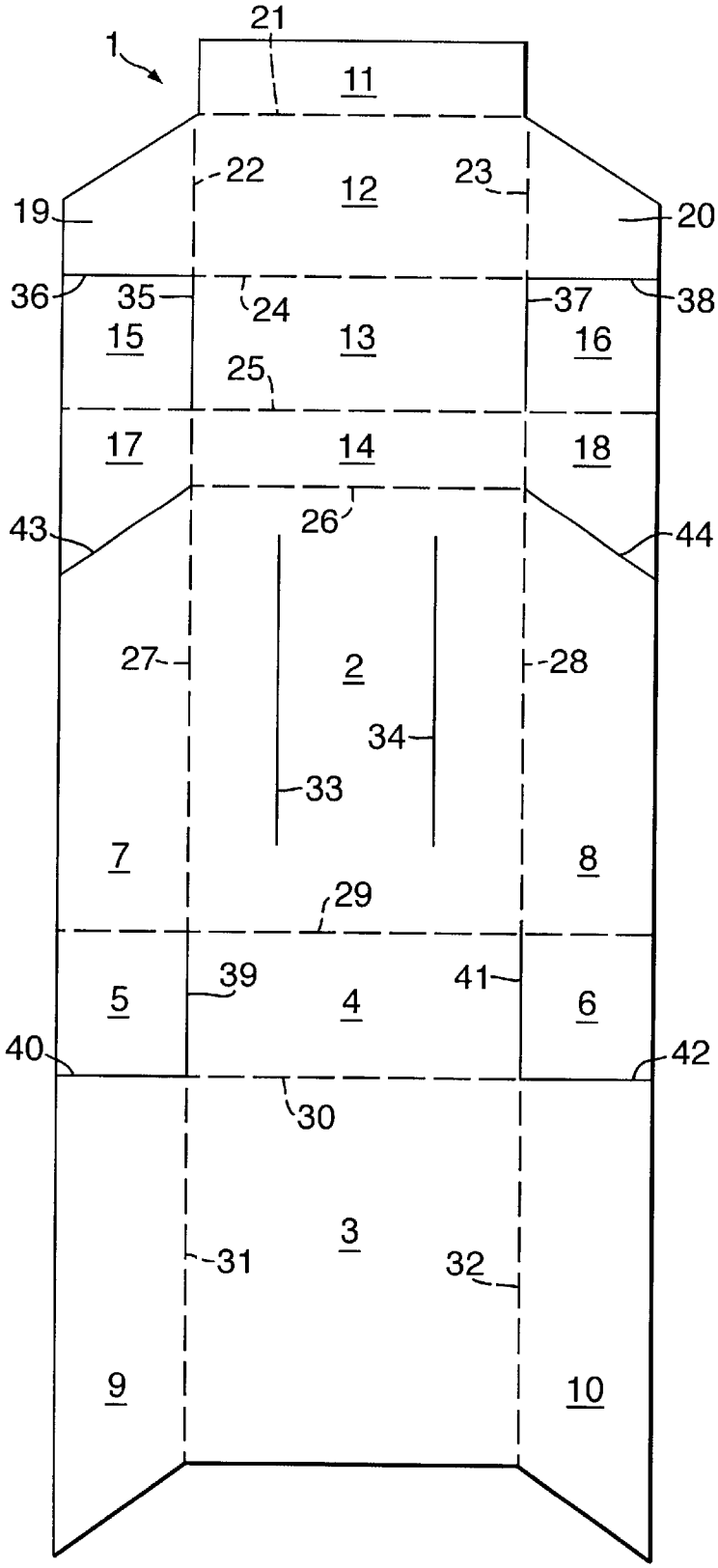
FIG. 1 shows a blank, in a flat condition thereof, of a conventional hinge-lid cigarette pack having had menthol applied thereto in accordance with the present invention.

A conventional hinge-lid cigarette pack when assembled is rectilinear. The blank depicted generally in FIG. 1 by reference numeral 1 of a hinge-lid cigarette pack, comprises a cardboard cut-out with a plurality of panels 2–20 and a plurality of fold lines 21–32. As is known to those skilled in the art, in respect of the body of the assembled pack, panel 2 forms the back wall, panel 3 forms the front wall, panels 4,5 and 6 form the bottom wall, panels 7,8,9 and 10 form the side walls; and panels 11,12,13,14,15,16,17,18,19 and 20 form the lid of the assembled pack. As will also be appreciated by those skilled in the cigarette packaging art, the solid lines in FIG. 1 (35–44) are lines of cut.

In a conventional cigarette packaging machine, an unfolded pack blank as per blank 1 is removed from a stack of blanks.

Adhesive is applied to the blank (typically on panel 2 thereof) and an assemblage (not shown) of cigarettes wrapped in a foil inner wrap is placed on and in alignment with panel 2 of the blank. The assemblage commonly comprises 20 cigarettes arranged in three lines, of seven, six and seven cigarettes respectively. The adhesive serves to adhere the foil inner wrap to the panel 2. An inner frame (not shown) is then positioned relative the assemblage and adhesive is applied to a surface of the inner frame such that when the blank is folded along fold lines 21–32 about the assemblage and inner frame, the inner frame is adhered to at least front wall panel 3 of the blank.

Figure 2:
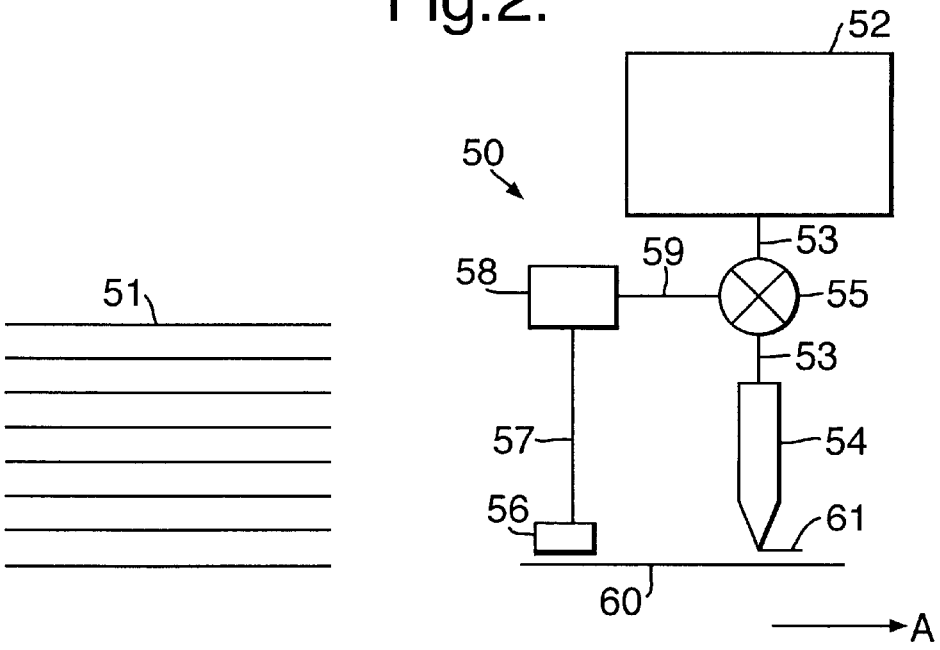
FIG. 2 depicts, very diagrammatically, parts of apparatus in accordance with the present invention.

In FIG. 2 reference numeral 50 designates generally volatile flavourant application means of an otherwise conventional cigarette packaging machine, a GDX2 for example.

Reference numeral 51 designates a stack of cigarette pack blanks, each as per blank 1 of FIG. 1. The packaging machine comprises conventional feed means (not shown) operable to remove one blank at a time from the base of the stack 51 and to feed a blank in the direction of arrow A.

The application means 50 comprises a heated reservoir 52 containing molten menthol (at 100% concentration as volatile flavourant), a heated supply line 53 interconnecting the reservoir 52 and two heated nozzles, one of which nozzles, designated by reference numeral 54, is shown in FIG. 2. A valve 55 is present in the supply line 53, which valve 55 is moveable between an open position and a closed position. When the valve 55 is in the open position, molten menthol flows from the reservoir 52 through the supply line 53, and to and through the nozzles 54.

The application means 50 further comprises optical sensing means 56, which sensing means 56 is operable to sense the presence of a pack blank being fed past the application means 50 by the aforesaid feed means and to provide, via a line 57, an electrical signal to valve activation means 58 of the application means 50. As is indicated in FIG. 2, the valve activation means 58 comprises a valve drive spindle 59 in drive engagement with the valve 55.

Associated with the sensing means 56 is electronic timing circuitry, which is not shown that is operable, when the sensing means 56 has sensed the presence of a blank 60, to cause the transmission of a signal via line 57, whereupon the activation means 58 causes the valve 55 to move from the closed position thereof to the open position thereof and subsequently to cause the transmission of a further signal in response to which the activation means 58 causes the valve 55 to return to the closed position thereof. The operation of the timing circuitry is such that the valve 55 is in the open position for a set time period, which set time period corresponds to the movement of the blank 60, beneath the two nozzles 54 of application means 50, in order that menthol is applied to the moving blank 60 as two elongate beads, as represented by reference numerals 33,34 in FIG. 1 in respect of blank 1. A partially formed bead is shown in FIG. 2 by reference numeral 61. The elongate beads 33,34 are located on the back panel 2, as may be seen in FIG. 1 with respect to blank 1, of the blank. Suitably, the beads 33,34 are parallel to each other, are about 3–4 cm apart and are each about 2 mm wide. As will be apparent to a person skilled in the art, the menthol can be applied to any one of the wall panels 1–20 and/or to the aforesaid inner frame.

Following application of the beads 32 and 34 to a blank, the blank is fed further forward, in the direction of arrow A as shown in FIG. 2, to stations of the packaging machine at which are performed the conventional cigarette packaging operations.

Thus downstream of the application means 50, adhesive is applied to the blank at requisite locations and an assemblage of cigarettes enwrapped in an inner foil wrap is positioned on the rear wall panel of the blank. The inner frame is then positioned relative to the assemblage and the blank is assembled, by folding, about the inner frame and assemblage.

Alternatively, the application of the menthol to the blank may occur after the application of the adhesive, or as a further alternative, the application of the menthol and the application of the adhesive may occur simultaneously. Of course, if the menthol is to be applied to the inner frame, this occurs as the inner frame is being positioned relative to the assemblage or immediately prior thereto.

Adhesive serving the known function of adhering inner foil wrap enwrapping the cigarette assemblage may be applied with menthol, menthol thus may be applied to the rear wall panel of the blank, for example.

In conventional manner, assembled packs are hermetically sealed on the packaging machine by means, for example, of a polypropylene outer wrap applied about each pack. During storage of the packaged smoking articles in the thus hermetically sealed packs, volatilised menthol migrates from the surface of the pack to the smoking articles.

For example, about 80 mg of molten menthol applied per pack of 20 cigarettes, results at equilibrium in a concentration of about 3.5 mg of menthol per cigarette.

While a preferred embodiment of a method for packaging smoking articles in accordance with the present invention has been set forth fully and completely hereinabove, it will be apparent to one of skill in the art that various changes could be made without departing from the true spirit and scope of the present invention which is accordingly to be limited only by the following claims.

What is claimed is:

1. A method of packaging smoking articles including:

providing a pack blank;

providing an assemblage of smoking articles;

placing said pack blank on a smoking article packaging machine for assembly;

providing a surface;

including said surface with said pack blank during said assembly of said pack blank;

applying a volatile smoking article flavourant to said surface during said assembly of said pack blank about said assemblage of smoking articles;

completing assembly of said pack blank about said assemblage of smoking articles on a smoking article packaging machine in an elapsed time short enough to prevent loss of said applied smoking article flavourant by volatization before completing assembly of said pack; and allowing said volatile smoking article flavourant to migrate from said surface to said smoking articles in said assembled pack.

2. The method of claim 1 further including providing said surface as an inner surface of said assembled pack.

3. The method of claim 2 further including providing said pack blank as a hinged-lid pack having an inner frame and wherein said surface is a part of said inner frame.

4. The method of claim 1 further including providing said surface as a surface of a pack insert disposed within said assembled pack.

5. The method of claim 1 further including applying said volatile flavourant directly to said surface.

6. The method of claim 1 further including using an adhesive to assemble said pack blank about said assemblage of smoking articles and applying said volatile flavourant in conjunction with applying said adhesive.

7. The method of claim 6 further including incorporating said volatile flavourant in said adhesive.

8. The method of claim 6 further including providing an inner wrap for said assemblage of smoking articles and using said adhesive to adhere said inner wrap to said pack blank.

9. The method of claim 6 further providing said pack blank with overlappable panels and using said adhesive to adhere said panels during said assembly of said pack blank.

10. The method of claim 1 further including hermetically sealing said assembled pack.

11. The method of claim 1 further including providing said surface as a surface of said pack blank.

12. In combination, a smoking article packaging machine and a volatile flavourant application means, said smoking article packaging machine being operable to assemble a pack blank about an assemblage of smoking articles; said volatile flavourant application means including nozzle means and means to supply a volatile flavourant through said nozzle means to a surface of said pack blank during assembly of said pack blank and prior to a full assembly of said pack blank about said assemblage of smoking articles, said surface being a surface within a fully assembled pack, said fully assembled pack including said pack blank, said assemblage of smoking articles and said surface, said smoking article packaging machine and said volatile flavourant application means being operable in combination whereby an elapsed time between an application of said volatile flavourant to said surface and said assembly of said pack blank is short enough to prevent loss of said applied volatile flavourant by volatilization prior to said full assembly of said fully assembled pack.

13. The combination of claim 12 wherein said volatile flavourant application means is part of said smoking article packaging machine.

14. The combination of claim 12 wherein said surface is a surface on said pack blank.

15. A method of packaging smoking articles including:

providing a pack blank;

providing an assemblage of smoking artricles;

placing said pack blank on a smoking article packaging machine for assembly;

providing a surface on said pack blank, said surface being an inner surface of a fully assembled pack;

applying a volatile smoking article flavourant to said surface prior to commencement of the assembly of said pack blank about said assemblage of smoking articles;

completing assembly of said pack blank about said assemblage of smoking articles on a smoking article packaging machine in an elapsed time short enough to prevent loss of said applied smoking article flavourant by volatization before said pack is fully assembled; and allowing said volatile smoking article flavourant to migrate from said surface to said smoking articles in said assembled pack.

* * * * *